United States Patent [19]

Snellman et al.

[11] Patent Number: 4,548,395

[45] Date of Patent: Oct. 22, 1985

[54] MICROFICHE FEEDER

[75] Inventors: Donald L. Snellman, 2807 W. Galer St., Seattle, Wash. 98199; Bernard A. Pearson; John W. Jacobs, both of King County, Wash.

[73] Assignee: Donald L. Snellman, Seattle, Wash.

[21] Appl. No.: 463,982

[22] Filed: Feb. 4, 1983

[51] Int. Cl.[4] ..... B65H 5/00

[52] U.S. Cl. ..... 271/11; 271/93; 271/98; 271/99; 271/105; 271/165; 271/122

[58] Field of Search ..... 271/10, 11, 12, 13, 271/90, 93, 94, 96, 97, 98, 99, 104, 105, 108, 114, 116, 122, 160, 165, 166, 35

[56] References Cited

U.S. PATENT DOCUMENTS

| | | | |
|---|---|---|---|
| 2,573,944 | 11/1951 | Anderson | 271/35 |
| 2,995,359 | 8/1961 | Gulick | 271/108 |
| 3,044,770 | 7/1962 | Breuers | 271/122 |
| 3,870,294 | 3/1975 | Donner | 271/35 |
| 4,164,234 | 8/1979 | Liepert | 271/108 |
| 4,168,058 | 9/1979 | Granzow et al. | 271/5 |
| 4,184,670 | 1/1980 | Rosendahl | 271/12 |
| 4,268,023 | 5/1981 | Anderson | 271/94 |
| 4,369,964 | 1/1983 | Jinnai et al. | 271/260 |

FOREIGN PATENT DOCUMENTS

| | | |
|---|---|---|
| 1027855 | 4/1966 | United Kingdom . |
| 1449390 | 11/1973 | United Kingdom . |
| 2055085 | 2/1981 | United Kingdom . |
| 2009110 | 10/1982 | United Kingdom . |
| 2040886 | 2/1983 | United Kingdom . |
| 2042480 | 7/1983 | United Kingdom . |

*Primary Examiner*—Bruce H. Stoner, Jr.
*Assistant Examiner*—John A. Carroll
*Attorney, Agent, or Firm*—Seed and Berry

[57] ABSTRACT

A microfiche feeder 10 conveys isolated sheets of microfiche from a stack 30 to a collator 12, sorter, or other processing apparatus. The stack of microfiche is placed in a receiver. A drive wheel 34 contacts the lowest sheet of the stack 30 to increment the sheet forward by suction as the wheel revolves. Spaced separator rolls 44 and 46 adjacent the drive wheel 34 ensure that a single sheet of microfiche is incremented forward to drive rolls 52 and 54, which convey the sheet to other processing apparatus.

20 Claims, 8 Drawing Figures

MICROFICHE FEEDER

DESCRIPTION

1. Technical Field

The present invention relates to a feeder for conveying single sheets of microfiche from a stack placed on a receiving shelf of the feeder.

2. Background Art

In other microfiche feeders, problems have arisen in separating the sheets of microfiche from one another and in conveying individual sheets to other processing apparatus, such as a collator. With the feeder of this invention, separation is nearly always accomplished, even at speeds of up to 8,000 sheets per hour.

DISCLOSURE OF INVENTION

The simple, fast, and economical microfiche feeder of this invention separates sheets of microfiche from a feed stack and conveys individual sheets to other processing apparatus, such as a collator. Stacked microfiche are placed on a receiving shelf of the feeder where individual sheets from the bottom of the stack are incremented forward by suitable means, such as a vacuum drive wheel contacting the lowest sheet. Separating rolls downstream from the vacuum drive wheel ensure isolation of a single sheet. Once separated, the sheet is conveyed into additional processing apparatus by associated conveying apparatus.

In a preferred embodiment, the microfiche feeder of this invention has a urethane-covered vacuum drive wheel which contacts the bottom of the stack of microfiche sheets and periodically uses a vacuum as it revolves to grip and cause a sheet of microfiche to move forward. Separating rolls isolate the sheet and pull it from the stack. The bottommost sheet of microfiche is driven forwardly by the bottom separator roll, while other sheets of microfiche are driven rearwardly by a top roll. By properly setting the distance between the rolls and by controlling the application of vacuum within the drive wheel, separation and isolation of a single sheet of microfiche is accomplished, even at speeds of up to 11,000 sheets/hour. Once isolated, the individual sheet of microfiche is pulled ahead by feed rolls which convey the sheet to other suitable conveying apparatus.

BEST MODE FOR CARRYING OUT THE INVENTION

Figure 1:
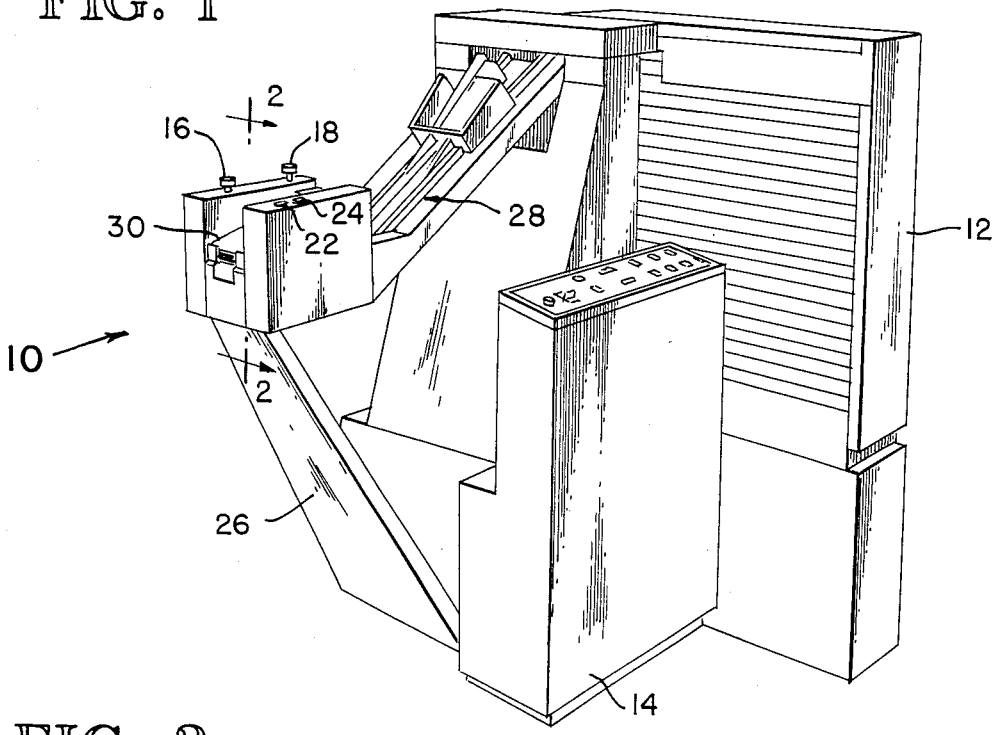
FIG. 1 is an isometric view of the microfiche feeder of this invention attached to a collator for processing microfiche.

As shown in FIG. 1, a collator 12 (such as a shifting bin collator available from Norfin, Inc.) has an attached control panel 14 to control the collator 12 and its microfiche feeder 10. The control panel 14 allows presetting for eight functions: hold, reset, stack, power, conveyor, collate, manual feed, and proof. When a collator 12 of the type shown in FIG. 1 is used, the control panel 14 also includes (i) mode choices of column shift and column selection, and (ii) counters to program the operation of the apparatus and to count the number of sheets processed.

The microfiche feeder 10 has two manual adjustment knobs 16 and 18 (FIG. 5) on its top. The first knob 16 is used to control the pressure which may be applied downwardly to the stack of microfiche held in the feeder tray 20 (FIG. 2) of the microfiche feeder 10. This stack pressure adjustment works through a lever-spring assembly (see FIG. 3). The second knob 18 is used to adjust the spacing between the separating rolls (FIG. 2) of a preferred feeder 10. That is, the second knob 18 is used to adjust the space between the rolls to allow passage of films of various thickness. The spacing assembly uses an eccentric cam system to vary the spacing between about 0.004 to 0.007 inch (FIG. 3).

The feeder 10 also includes control means to allow use of the feeder without a separate control panel 14. Button 22 sets the feeder 10 for a collating mode while button 24 sets it for a manual feed mode.

An adjustable slant leg 26 holds the feeder 10 in position. Sheets leaving the feeder 10 are conveyed by suitable conveying apparatus 28 (usually including manual feed means and proof means) to the collator 12.

1. The General Operation

Figure 2:
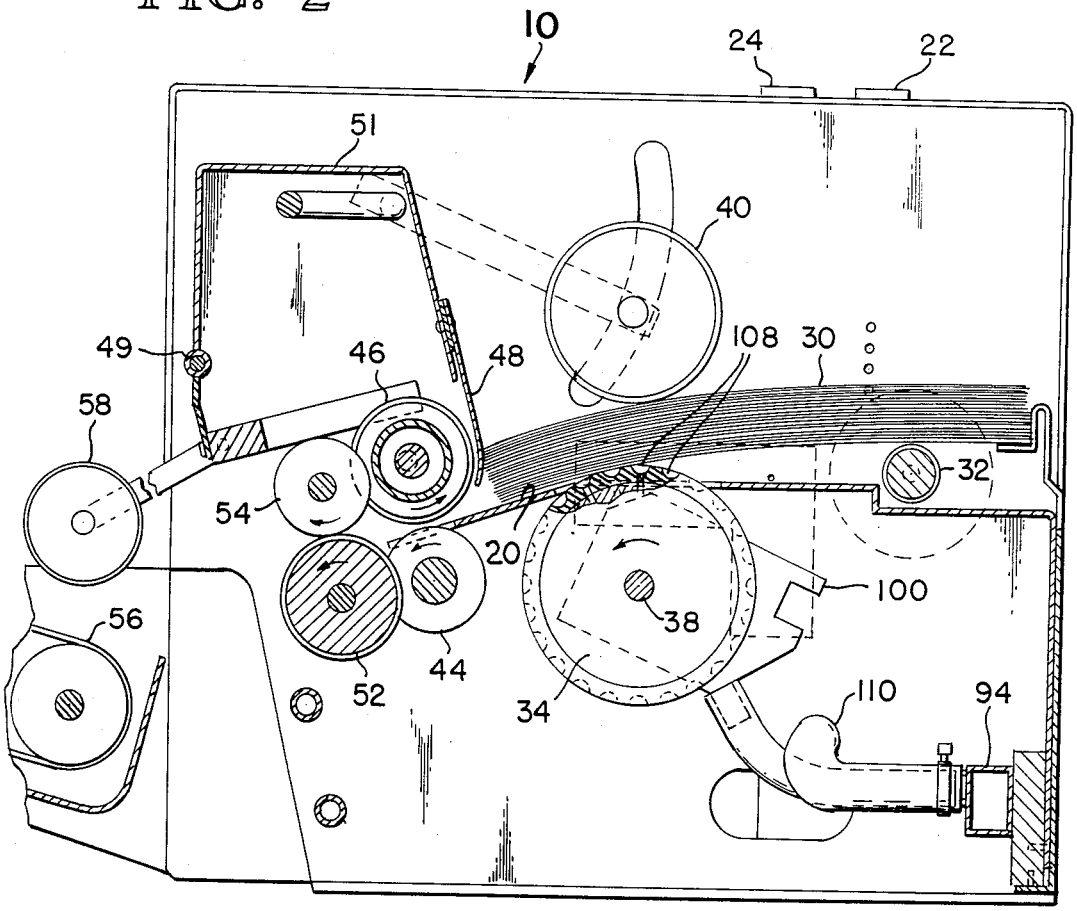
FIG. 2 is a sectional view taken along line 2—2 of FIG. 1.
Figure 3:
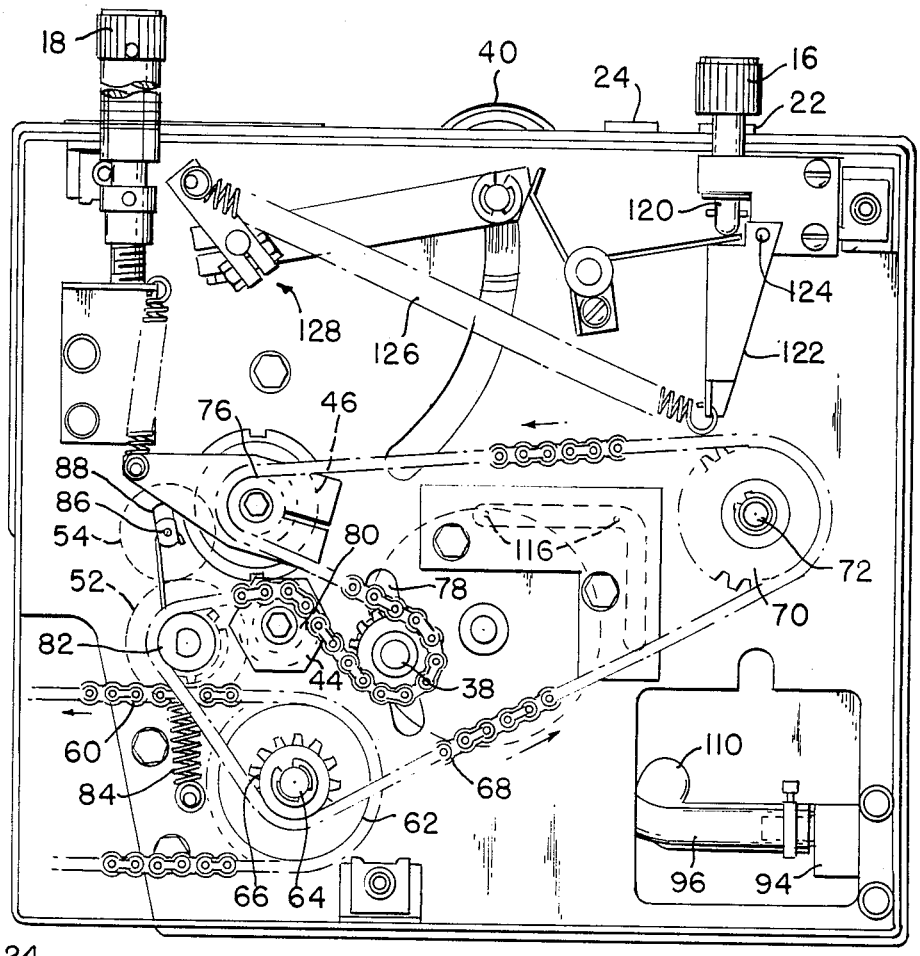
FIG. 3 is a side elevation of the microfiche feeder of this invention showing a preferred drive assembly.

As shown in FIG. 2, a stack of microfiche 30 is placed on a tray 20. The stack may be supported on one end by an idler roller 32 (FIG. 5) to reduce the friction between the stack of microfiche 30 and the surface of the tray 20 and to accommodate the natural curl of the fiche. A main drive wheel 34, preferably having a longitudinally grooved, polyurethane plastic coating 36 (FIG. 6) is rotatably mounted on a shaft 38 transverse to the stack 30. The drive wheel 34 contacts the bottom sheet of the stack and moves that sheet forward relative to the other sheets in the stack 30 by holding the sheet with suction as the wheel 34 revolves (as will be explained). A weighted roller 40 (FIG. 6) having two spaced O-rings 42 may be used to contact the upper surface of the stack of microfiche 30. This weighted roller 40 exerts a downward force on the stack 30 so that the stack firmly contacts the drive wheel 34. Often the weighted roller 40 is unnecessary. Its downward force is adjustable through a spring-lever assembly (FIG. 3) (as will be explained).

Incremented forward by the drive wheel 34, the microfiche sheet engages separator rolls 44 and 46, which are spaced apart a predetermined, preset distance to allow isolation of an individual sheet of microfiche. A face plate 48 which is vertically adjustable assists separation of one sheet from the stack by allowing only two or three sheets of microfiche at the most to reach the rolls 44 and 46.

To ensure better contact of the upper separating roll 46 with the microfiche, the roll 46 includes a urethane coating 50 of a durometer hardness between about 65–75. The roll 46 imports a relatively large backward thrust to the fiche. In contrast, the bottom roll 44 is made of anodized steel, which is essentially scratchless for the microfiche being conveyed. The bottom roll may be coated with urethane.

The separator rolls 44 and 46 ensure that only a single sheet of microfiche passes to a pair of spaced feeder rolls 52 and 54. These feeder rolls 52 and 54 (Roll 54 is split so that it only contacts the edges of the fiche.) pull the single sheet of microfiche and feed it to a driven conveyor belt 56, which carries the individual sheet to further processing. An idler roller 58 may be used to ensure contact of the sheet with the conveyor belt 56, and is used to overcome the natural curl of the microfiche, which might otherwise lead to a jam on the conveyor belt 56.

2. The Drive Mechanism

Figure 4:
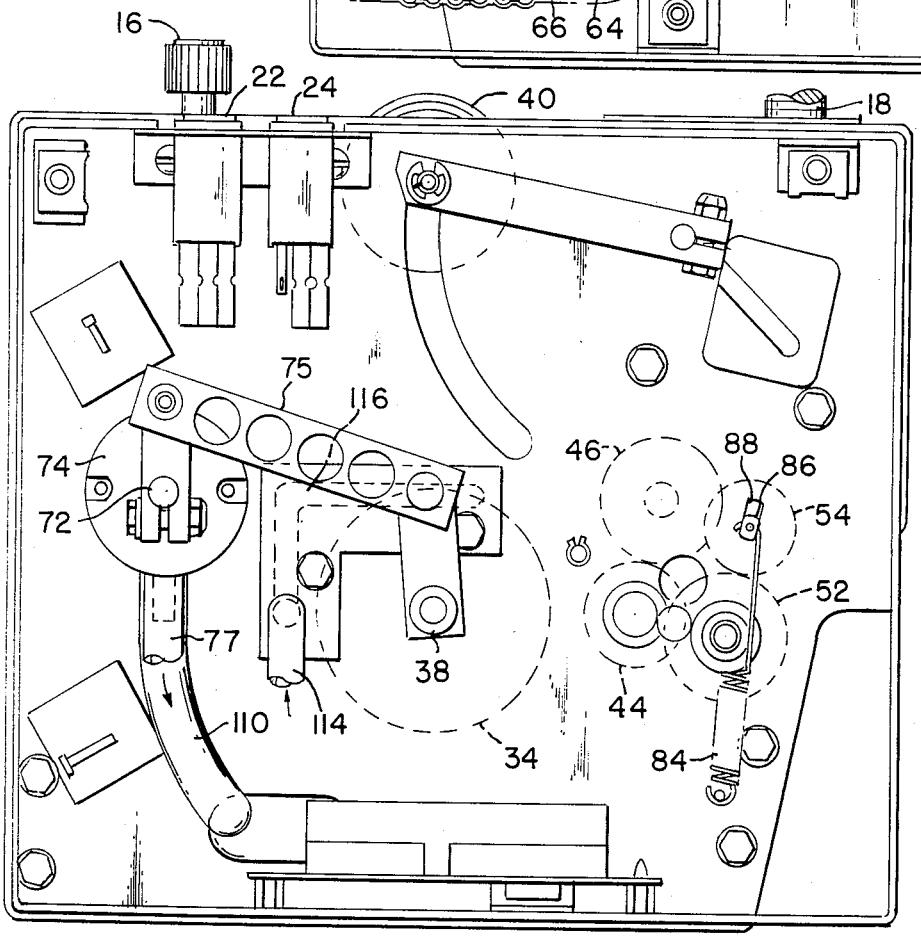
FIG. 4 is a detailed side elevation, from the side opposite that shown in FIG. 3, showing a preferred vacuum control for the drive wheel.

As shown in FIGS. 3 and 4, the microfiche feeder 10 is driven in conjunction with the collator conveying apparatus. An input belt 60 couples the microfiche feeder 10 to the conveyor belt drive, and powers the entire feeder 10, The belt 60 engages an input sprocket 62 on shaft 64 and subsequently drive output sprocket 66 to drive an endless belt 68. The belt 68 drives the various devices of the microfiche feeder 10 (as will be explained).

The belt 68 engages a sprocket 70 affixed to shaft 72 which passes through the microfiche feeder 10 to a rotary face valve 74 (FIG. 4) that controls the application of suction to the main drive wheel 34. The rotation of shaft 72 is coupled to the main drive wheel shaft 38 through a suitable linkage 75 which increments the drive wheel 34 forwardly a partial revolution for each complete revolution of the rotary face valve. This linkage 75 includes a one-way clutch (not shown) to ensure that the main drive wheel 34 only turns in one direction. The linkage 75 draws the shaft 38 of the main drive wheel 34 forwardly over a portion of its movement and is disengaged as the linkage 75 resets for a second foward increment.

The endless belt 68 also engages a sprocket 76 on the shaft for the upper separating roll 46 to drive the upper separating roll 46 in a counterclockwise direction. The belt 68 continues in a horseshoe loop around an idler sprocket 78 floating on the shaft 38 of the main drive wheel 34 and engages a sprocket 80 to drive the lower separating roll 44 in the same counterclockwise direction as upper separating roll 46. Finally, the belt 68 engages a sprocket 82 affixed to the shaft of the lower drive roll 52 to drive the lower drive roll 52 in a counterclockwise direction. Spring clips 84 hold the upper drive roll 54 in contact with the lower drive roll 52 to ensure that the upper drive roll 54 turns in the opposite rotational sense from the lower drive roll 52. As shown in FIGS. 3 and 4, the shaft 86 of the upper drive roll 54 floats in a slot 88 to allow passage of a single sheet of microfiche through the drive rolls 52 and 54.

3. The Vacuum System

Figure 7:
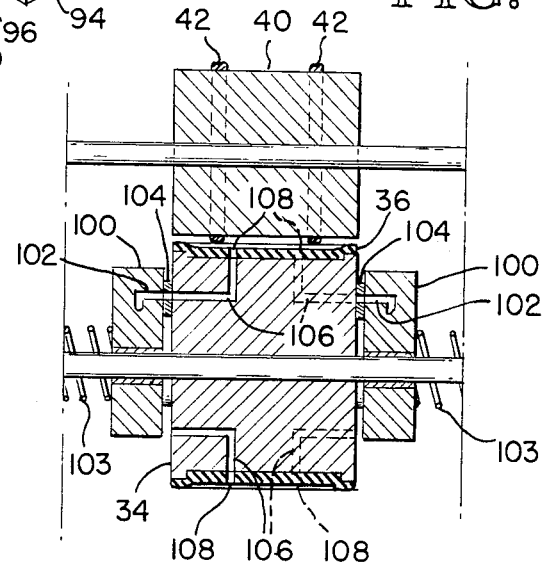
FIG. 7 is a sectional view taken along line 7—7 of FIG. 6.

A vacuum pump 90 (FIG. 8), through a valve 74 and manifold 94, pulls a vacuum through the main drive wheel 34. Vacuum lines 96 and 98 of TYGON ® tubing connect the manifold 94 with vacuum blocks 100 which idle about the shaft 38 of main drive wheel 34. The blocks 100 include an internal passage 102 while links with a passage in bearing disk 104 (FIG. 7). Each bearing disk 104 allows the completion of a vacuum loop system while allowing the main drive wheel 34 to freely revolve as shaft 38 revolves. Springs 103 bias the blocks 100 against the disks 104 and wheel 34. A complete vacuum path will be established first on the right and then on the left. That is, a vacuum will be pulled through line 98, through right block 100, through the bearing disk 104, and through a passage 106 within the main drive wheel 34 to create a suction at one opening 108 of the main drive wheel 34. When the main drive wheel 34 increments forward, a vacuum path on the left will be created, while the path on the right will be blocked. The suction created at the hole 108 is sufficient to draw the bottom sheet of microfiche in close contact with the main drive wheel 34.

The rotary face valve 74 (FIG. 4) is designed to control suction through line 110 and the manifold 94 at designated stages during the movement of a single sheet toward the separating rolls 44 and 46. More specifically, the rotary face valve completes the vacuum loop through lines 77, 110, and either 96 or 98 at a first stage to allow the bottom sheet of microfiche to be drawn to the main drive wheel 34 as the wheel revolves in the counterclockwise direction. Because suction holds the bottom sheet, the sheet moves forwardly with the wheel 34. The vacuum is maintained as the microfiche begins to feed into the separating rolls 44 and 46, but is discontinued at a point where there remains an overlap between the bottom sheet of microfiche and the next lowest sheet in the stack. The vacuum is discontinued at this point so that the rolls 52 and 54 may convey the lowest sheet of microfiche forwardly. The next lowest sheet is not incremented forwardly because it now is held by the wheel 34. That is, in a third stage, the rotary face valve 74 completes the vacuum loop to have suction at the wheel 34 immediately after the lowest sheet (drawn by roll 44) clears the next lowest sheet. That is, the vacuum system is on in a cyclical pattern using vacuum to move the lowest sheet forward, interrupting the vacuum to allow the separating rolls to pull the lowest sheet from the stack and applying a vacuum again so that the main drive wheel 34 holds back the remaining sheets of the microfiche in the stack 30.

4. Compressed Air Separation

Figure 8:
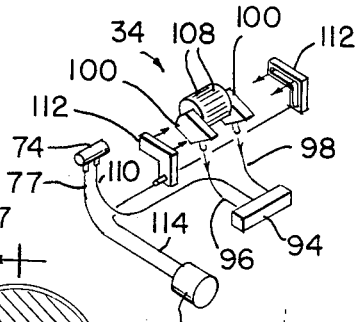
FIG. 8 is a schematic isometric of the vacuum-compressed air circulation for the feeder of FIG. 1.

As shown in FIG. 3, and as schematically diagrammed in FIG. 8, the exhaust of vacuum pump 90 may be used to help separate sheets. Exhaust compressed air from the pump 90 enters blocks 112 through lines 114 and is directed through pinholes 116 outwardly to fluff the lowest sheets of microfiche in the stack 30. This blowing of compressed air helps to reduce the frictional interengagement of the sheets and greatly aids their separation. The pinholes 116 are positioned immediately above the receiver tray 20 so that the compressed air is directed at the bottom of the stack. The vacuum of the main drive wheel 34 insures that the lowest sheet of the stack 30 will be positively incremented forward while the compressed air jets tend to lift the remaining sheets away from the lowest sheet.

5. The Stack Pressure Adjustment

As shown in FIG. 3, turning knob 16 causes its threaded shaft 122 to move downwardly. This motion causes lever 122 to pivot counterclockwise about pivot 124 to stretch spring 126. The spring 126 acts through a linkage 128 to reduce the pressure applied to the stack. That is, the spring 126 tends to pull the weighted roll 40 upwardly.

Figure 5:
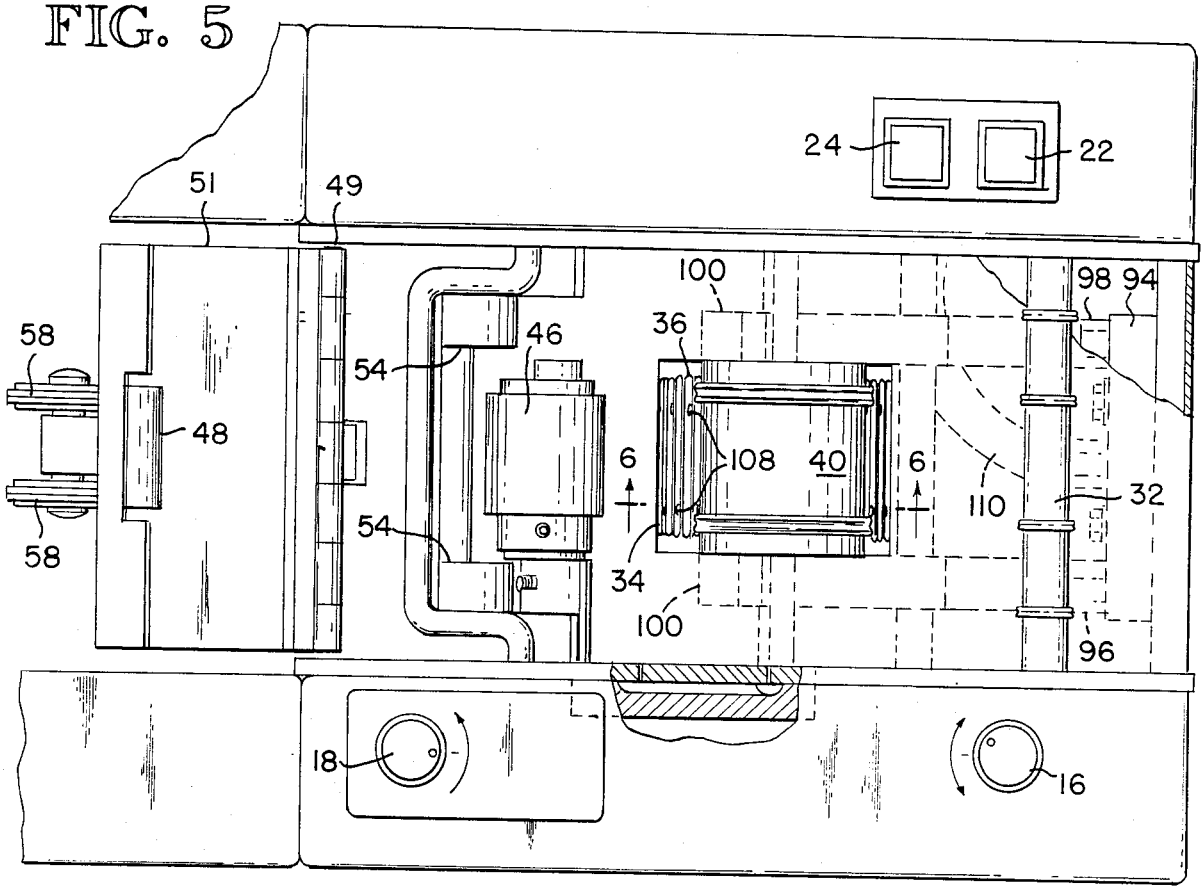
FIG. 5 is a top plan view of the feeder of FIG. 1, partially in cutaway.
Figure 6:
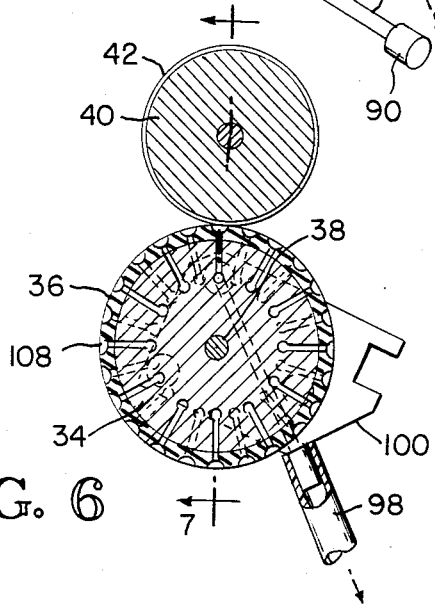
FIG. 6 is a sectional view taken along line 6—6 of FIG. 5.

FIG. 5 shows cover 51 pivoted upwardly about hinge 49 to expose the underlying drive roll 54.

We claim:

1. A microfiche feeder for conveying single sheets of microfiche, from a stack of microfiche to a collator, sorter, or other processing apparatus, comprising:

(a) a receiver for receiving a stack of microfiche;

(b) an incrementally driven, coated vacuum drive wheel having a friction coating to convey the lowest sheet from the stack;

(c) spaced, separating rolls adjacent to the drive wheel for receiving the sheet moved by the drive wheel, the separating rolls rotating in the same direction as the drive wheel, the lower separating roll conveying the sheet forward while the upper separating roll urges other sheets of microfiche rearwardly to help isolate a single sheet of microfiche;

(d) means for accepting the single sheet from the separating rolls and for conveying the single sheet from the feeder to other processing apparatus; and (e) vacuum control means to selectively control application of suction at the drive wheel to enhance separation of a single sheet of microfiche from the stack, the means applying a suction to the lowest microfiche at and immediately before the drive wheel begins to revolve and discontinuing the suction as the microfiche begins to feed to the separating rolls.

2. The microfiche feeder of claim 1, including a weighted roller resting against the top of the stack of microfiche in the receiver and means operatively associated with the weighted roller to vary the weight applied to the stack of micorfiche.

3. The feeder of claim 1, further comprising means for directing compressed air transversely at the bottom of the stack to aid separation of the sheets.

4. A microfiche feeder for conveying single sheets of microfiche at high speeds up to about 8,000 sheets per hour from a stack to a collator, a sorter, or other processing apparatus, comprising:

(a) a receiver for receiving a stack of microfiche;

(b) an incrementally revolving, vacuum-powered drive wheel to contact the lowest sheet of microfiche and to convey that lowest sheet forwardly when the drive wheel revolves;

(c) a vacuum control means to supply suction at the drive wheel immediately before and during a first incremental revolution, to cut the suction to allow the sheet to be drawn to the other processing apparatus, and to supply the suction again to hold the remaining sheets back as a single sheet is withdrawn; and (d) means for further processing the single microfiche sheet, including means to receive the sheet incremented forwardly by the drive wheel.

5. The feeder of claim 4 wherein the vacuum control means includes a rotary face valve.

6. The feeder of claim 4 wherein the drive wheel includes a plurality of openings and the vacuum control means includes a vacuum assembly to allow drawing a suction through only one opening at a time.

7. The feeder of claim 4 wherein the means for further processing includes a pair of spaced, adjustable separating rolls which revolve in a common rotational sense and a pair of drive rolls immediately following the separating rolls, wherein the separating rolls receive a sheet of microfiche from the drive wheel and convey the isolated sheet to the drive rolls.

8. The feeder of claim 7 wherein the drive wheel includes a plurality of spaced openings about the periphery of the wheel and the vacuum control means includes suitable means to provide a suction at only one opening at a time.

9. The feeder of claim 8 wherein the vacuum control means further includes a rotary face valve to regulate the application of suction.

10. The feeder of claim 7 wherein the separating rolls have a coating of a durometer hardness between about 65–75 to ensure isolation of separate sheets of microfiche.

11. The feeder of claim 4, further comprising means for directing compressed air transversely at the bottom of the stack to aid separation of the sheets.

12. The microfiche feeder of claim 4 wherein the drive wheel is coated to reduce scratching of the microfiche.

13. The microfiche feeder of claim 4 wherein the drive wheel is revolved incrementally with a shaft revolving at a predetermined speed and a linkage between the shaft and the drive wheel to increment the drive wheel forwardly a partial revolution for each revolution of the shaft.

14. A microfiche to convey single sheets of microfiche from a stack to a collator, sorter, or other processing apparatus, comprising:

(a) a receiver for receiving a stack of microfiche;

(b) an incrementally driven vacuum drive wheel positioned to contact the lower surface of the stack to separate and convey the lowest sheet from the stack by the use of suction during rotation of the wheel, the wheel being coated to provide a substantially scratch-free surface for the microfiche;

(c) separating means for receiving the sheet conveyed by the drive wheel and for ensuring isolation of a single sheet of microfiche;

(d) means for accepting the single sheet from the separation means and conveying the single sheet to conveying apparatus for further processing of the sheet without scratching the sheet; and (e) a vacuum control means to supply suction at the drive wheel immediately before and during a first incremental revolution of the drive wheel and to discontinue the suction to allow the sheet to be drawn to the separating means.

15. The microfiche feeder of claim 14 wherein the separating means includes a pair of spaced separating rolls between which the drive wheel feeds the sheet of microfiche, the separator rolls rotating in the same direction as the drive wheel.

16. The feeder of claim 14 wherein the vacuum control means includes a rotary face valve.

17. The feeder of claim 16 wherein the drive wheel includes a plurality of openings and the vacuum control means includes a vacuum assembly to allow drawing a suction through only one opening at a time.

18. A microfiche feeder to convey single sheets of microfiche from a stack to a collator, sorter, or to other processing apparatus, comprising:

(a) a receiver for receiving a stack of microfiche;

(b) an incrementally driven vacuum drive wheel positioned to contact the lower surface of the stack to separate and convey the lowest sheet from the stack by use of suction during rotation of the wheel;

(c) separating means for receiving the sheet conveyed by the drive wheel and for ensuring isolation of a single sheet of microfiche;

(d) means for accepting the single sheet from the separating means and conveying the single sheet to conveying apparatus for further processing of the sheet; and (e) a vacuum control means to supply the vacuum to the drive wheel, the control means applying a suction immediately before and during a first incremental revolution of the drive wheel and discontinuing the vacuum to allow the microfiche to enter the separating means.

19. The feeder of claim 18, further comprising means for directing compressed air transversely at the bottom of the stack to aid separation of the sheets.

20. The microfiche feeder of claim 18 wherein the drive wheel includes a plurality of openings and wherein the control means includes an assembly to allow drawing a suction through only one opening at a time.

* * * * *